US007562833B2

(12) United States Patent
Perkins et al.

(10) Patent No.: US 7,562,833 B2
(45) **Date of Patent: *Jul. 21, 2009**

(54) SPRINKLER WITH MAGNETIC NUTATING MECHANISM AND RELATED METHOD

(75) Inventors: Lee A. Perkins, Lowden, WA (US); Craig Nelson, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 198 days.

This patent is subject to a terminal disclaimer.

(21) Appl. No.: 11/606,958

(22) Filed: Dec. 1, 2006

(65) Prior Publication Data

US 2008/0017732 A1 Jan. 24, 2008

Related U.S. Application Data

(63) Continuation-in-part of application No. 11/490,066, filed on Jul. 21, 2006, now Pat. No. 7,287,710.

(51) Int. Cl.
*B05B 3/04* (2006.01)

(52) U.S. Cl. ..... 239/222.17; 239/222.11; 239/498; 239/505; 239/DIG. 11

(58) Field of Classification Search ..... 239/222.11, 239/222.17, 222.21, 223, 224, DIG. 11, 498, 239/502, 503, 505, 507, 509, 510, 512, 524
See application file for complete search history.

(56) References Cited

U.S. PATENT DOCUMENTS

| | | | |
|---|---|---|---|
| 2,848,276 | A | 8/1958 | Clearman |
| 3,009,648 | A | 11/1961 | Hait |
| 3,034,728 | A | 5/1962 | Hruby, Jr. |
| 3,091,400 | A | 5/1963 | Aubert |
| 3,532,273 | A | 10/1970 | Siddal et al. |
| 3,682,388 | A | 8/1972 | Ferguson |
| 3,958,643 | A | 5/1976 | Landsberg |
| 3,964,685 | A | 6/1976 | Chauvigne |
| 4,073,438 | A | 2/1978 | Meyer |
| 4,487,368 | A | 12/1984 | Clearman |
| 4,795,100 | A | 1/1989 | Puretell et al. |
| 5,333,796 | A | 8/1994 | Purtell et al. |
| 5,381,960 | A | 1/1995 | Sullivan et al. |
| 5,439,174 | A | 8/1995 | Sweet |
| 5,588,595 | A | 12/1996 | Sweet et al. |

(Continued)

OTHER PUBLICATIONS

Nelson et al., entitled, "Sprinkler With Magnetic Nutating Mechanism and Related Method," U.S. Appl. No. 11/490,066, filed Jul. 21, 2006, pending.

(Continued)

*Primary Examiner*—Christopher S Kim
(74) *Attorney, Agent, or Firm*—Nixon & Vanderhye, P.C.

(57) ABSTRACT

A sprinkler including a sprinkler head incorporating a nozzle; a spool fixed to the sprinkler head in proximity to the nozzle; a cage assembly loosely mounted on the spool, the assembly including a distribution plate at a first end of the assembly downstream of the nozzle and a first magnet at a second opposite end of the assembly upstream of the spool; a mounting element fixed to the assembly between the first and second ends, an inner edge of the mounting element loosely confined between upper and lower flanges of the spool; and a second magnet fixed to the sprinkler head, axially between the spool and the first magnet.

12 Claims, 10 Drawing Sheets

U.S. PATENT DOCUMENTS

| | | | | |
|---|---|---|---|---|
| 5,671,885 | A | 9/1997 | Davisson | |
| 5,765,945 | A | 6/1998 | Palmer | |
| 5,950,927 | A | 9/1999 | Elliott et al. | |
| 6,092,739 | A | 7/2000 | Clearman et al. | |
| 6,129,293 | A | 10/2000 | Jager | |
| 6,176,440 | B1 | 1/2001 | Elliott | |
| 6,186,414 | B1 | 2/2001 | Clearman et al. | |
| 6,199,771 | B1 | 3/2001 | Clearman et al. | |
| 6,267,299 | B1 | 7/2001 | Meyer | |
| 6,360,965 | B1 | 3/2002 | Clearman et al. | |
| 6,382,525 | B1 | 5/2002 | Santiesteban et al. | |
| 6,431,475 | B1 | 8/2002 | Williams | |
| 6,439,477 | B1 | 8/2002 | Sweet et al. | |
| 6,530,532 | B1 | 3/2003 | Santiesteban et al. | |
| 6,932,279 | B2 | 8/2005 | Burcham | |
| 7,070,122 | B2 | 7/2006 | Burcham et al. | |
| 7,287,710 | B1 * | 10/2007 | Nelson et al. | 239/222.17 |
| 2006/0091232 | A1 | 5/2006 | Grant | |

OTHER PUBLICATIONS

Grant, entitled, "Water Deflection Subassembly," U.S. Appl. No. 11/266,054, filed Nov. 3, 2005, pending.

Grant, entitled, "Water Deflection Subassembly," U.S. Appl. No. 60/784,295, filed Mar. 21, 2006, pending.

Grant, entitled, "Fluid Distributing Device and Method," U.S. Appl. No. 60/901,562, filed Feb. 14, 2007, pending.

* cited by examiner

SPRINKLER WITH MAGNETIC NUTATING MECHANISM AND RELATED METHOD

This application is a continuation-in-part of application Ser. No. 11/490,066, filed Jul. 21, 2006 now U.S. Pat No. 7,287,710.

BACKGROUND OF THE INVENTION

This invention relates to sprinkler heads and, more particularly, to sprinkler heads that nutate while they rotate to minimize the "donut effect" prevalent with conventional non-nutating sprinkler heads.

Various nutating or wobbling sprinkler head designs have been available but with potential shortcomings that can nullify the very nutating effect that makes such sprinklers attractive in the first instance. Examples of known nutating or wobbling sprinkler heads may be found in prior U.S. Pat. Nos. 5,381,960; 5,950,927; and 6,932,279. Commonly owned U.S. Pat. Nos. 5,439,174; 5,588,595; 5,671,885; 6,267,299; and 6,439,477 provide further examples of nutating or wobbling sprinkler heads.

One problem often encountered with sprinklers of this type relates to stalling at start up or during normal operation. Stalling occurs when the water distribution plate of the sprinkler head fails to tilt at start up, or ceases tilting during operation, thereby simply rotating and distributing a stream particularly susceptible to the "donut effect" where the wetted pattern area is shaped like a solid ring around a dry center. When nutating or wobbling sprinklers operate as designed, the nutating action tends to fill in the pattern in a substantially uniform manner. Thus, it is critical that the water distribution plate reliably and consistently remain in a tilted orientation while rotating to achieve the desired nutating action.

BRIEF SUMMARY

In one exemplary embodiment, a sprinkler head includes an adapter, nozzle body and spindle assembly that supports a nutating cage and water distribution plate. The cage is loosely supported on a double-flanged spool secured to the spindle, allowing the cage and water distribution to rotate and nutate about the spindle. The cage supports one magnet ring and the spindle supports another, in proximity to one another, with like poles facing each other. With this arrangement, and before water under pressure is supplied to the sprinkler head, the repulsion force between the magnets moves the cage and cage magnet along the spindle spool away from the spindle magnet which, at the same time, draws the water distribution plate upwardly (in the orientation of FIG. 2) toward the spindle and nozzle. Because of the annular shape of the two magnets and their relative alignment, the water distribution plate is maintained in a non-tilted position, substantially perpendicular to the longitudinal center axis of the sprinkler head, when at rest.

When water under pressure is supplied to the sprinkler head, the force of the water on the water distribution plate pushes the plate, cage and cage magnet downwardly, toward the spindle magnet. As the cage magnet approaches the spindle magnet, the magnetic repulsion force increases, creating positional instability in the cage assembly, causing the cage and water distribution plate to tilt off axis. So long as water emitted from the nozzle impinges on the deflection plate, pushing the cage magnet towards the spindle magnet, the distribution plate will remain tilted as it rotates, resulting in a nutating or wobbling motion as the distribution plate rotates.

In another exemplary embodiment, the spindle magnet lies axially between the spool flanges while the cage magnet forms the upper one of the two axially spaced spool flanges. The operation of the device remains substantially as described above.

In a third exemplary embodiment, the opposed magnets are located in a cap assembly incorporating the water distribution plate and located downstream of the sprinkler nozzle and spindle. Here again, at rest, the repulsion force pushes the water distribution plate (and cage magnet) away from the fixed magnet in the cap assembly, and maintains the water distribution plate in a substantially non-tilted position. When water under pressure strikes the distribution plate, causing it to rotate, the magnetic force between the pair of magnets increases to destabilize the distribution plate and to cause it to tilt.

In a fourth embodiment, the components are generally as described above in connection with the second embodiment but, in this case, the fixed magnet is seated in a stationary strut assembly surrounding the cage and distribution plate.

In a fifth embodiment, the magnet on the cage assembly and the magnet on the spindle are located above the spool (in an "upstream" direction). In this arrangement, the cage assembly is caused to tilt off axis even at the rest position.

Accordingly, the invention in one aspect relates to a sprinkler comprising: a sprinkler head incorporating a nozzle; a spool fixed to the sprinkler head in proximity to the nozzle; a cage assembly loosely mounted on the spool, the assembly including a distribution plate at a first end of the assembly downstream of the nozzle and a first magnet at a second opposite end of the assembly upstream of the spool; a mounting element fixed to the assembly between the first and second ends, an inner edge of the mounting element loosely confined between upper and lower flanges of the spool; and a second magnet fixed to the sprinkler head, axially between the spool and the first magnet.

In another aspect, the invention relates to a sprinkler device comprising: a nozzle adapted to be connected to a source of liquid under pressure; a first component having a water distribution plate attached at one end thereof, the water distribution plate located proximate the nozzle and having at least one groove therein; the first component and the water distribution plate supported on a spool enabling both spinning and nutating motion when liquid from the nozzle impinges on the water distribution plate; and a pair of magnets including a first magnet mounted on the first component and a second magnet mounted on a fixed second component proximate the first magnet, with like poles of the first and second magnets opposing each other to create a repelling force that causes the first component to resist movement in a direction towards the second magnet.

In still another aspect, the invention relates to a method of deflecting a fluid flowing in an axial direction to a generally radial direction comprising: directing fluid flowing in the axial direction onto a distribution plate formed with a plurality of grooves shaped and arranged to cause the distribution plate to spin about its axis; loosely supporting the dispensing element relative to a support structure that permits the dispensing element to simultaneously spin and nutate in a substantially circular path; and utilizing a magnetic repelling force to orient the distribution plate relative to the support structure.

The exemplary embodiments will now be described in detail in connection with the drawings identified below.

DETAILED DESCRIPTION OF THE DRAWINGS

Figure 1:
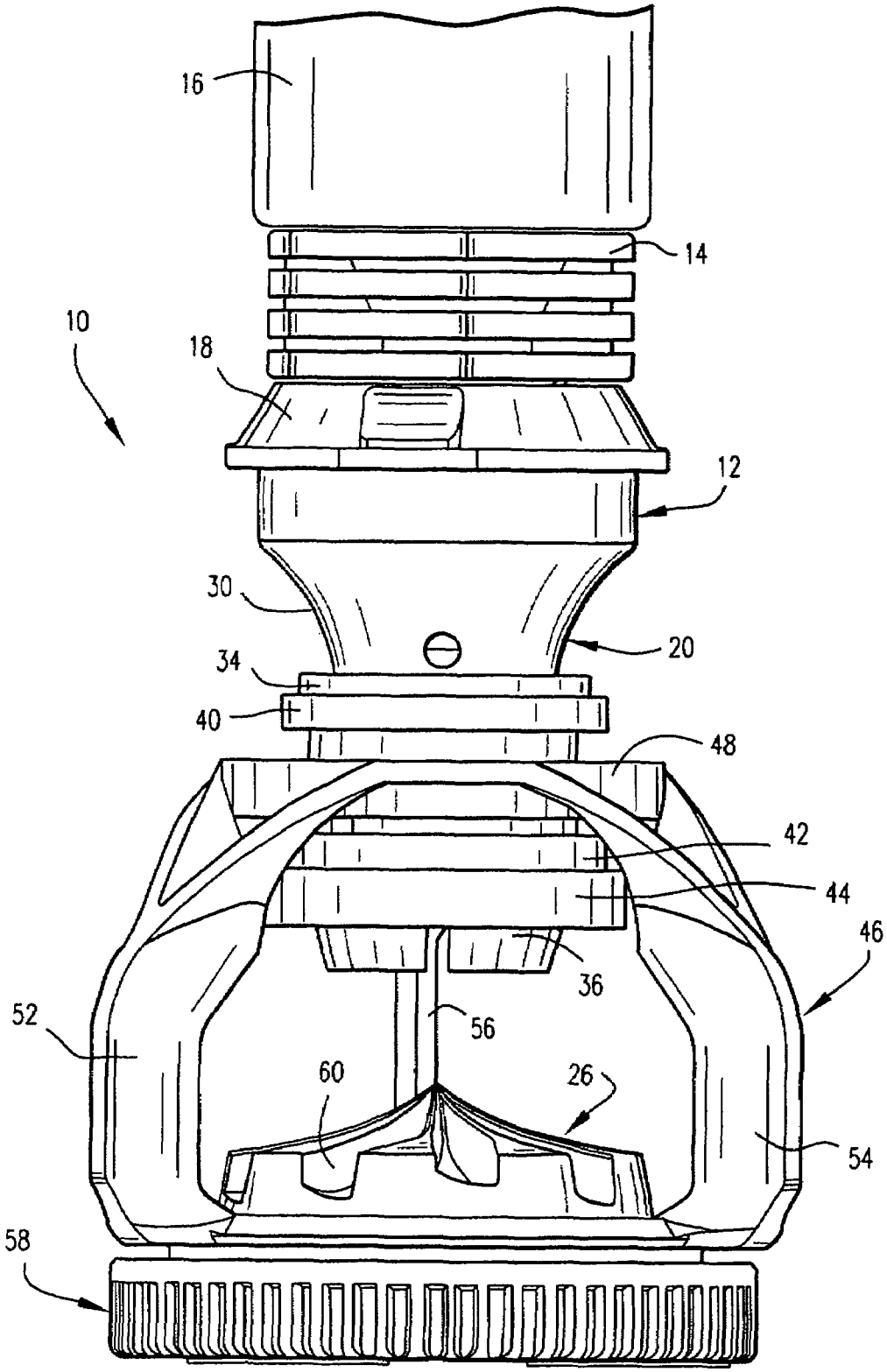
FIG. 1 is a front elevation of a sprinkler head in accordance with a first exemplary embodiment.
Figure 2:
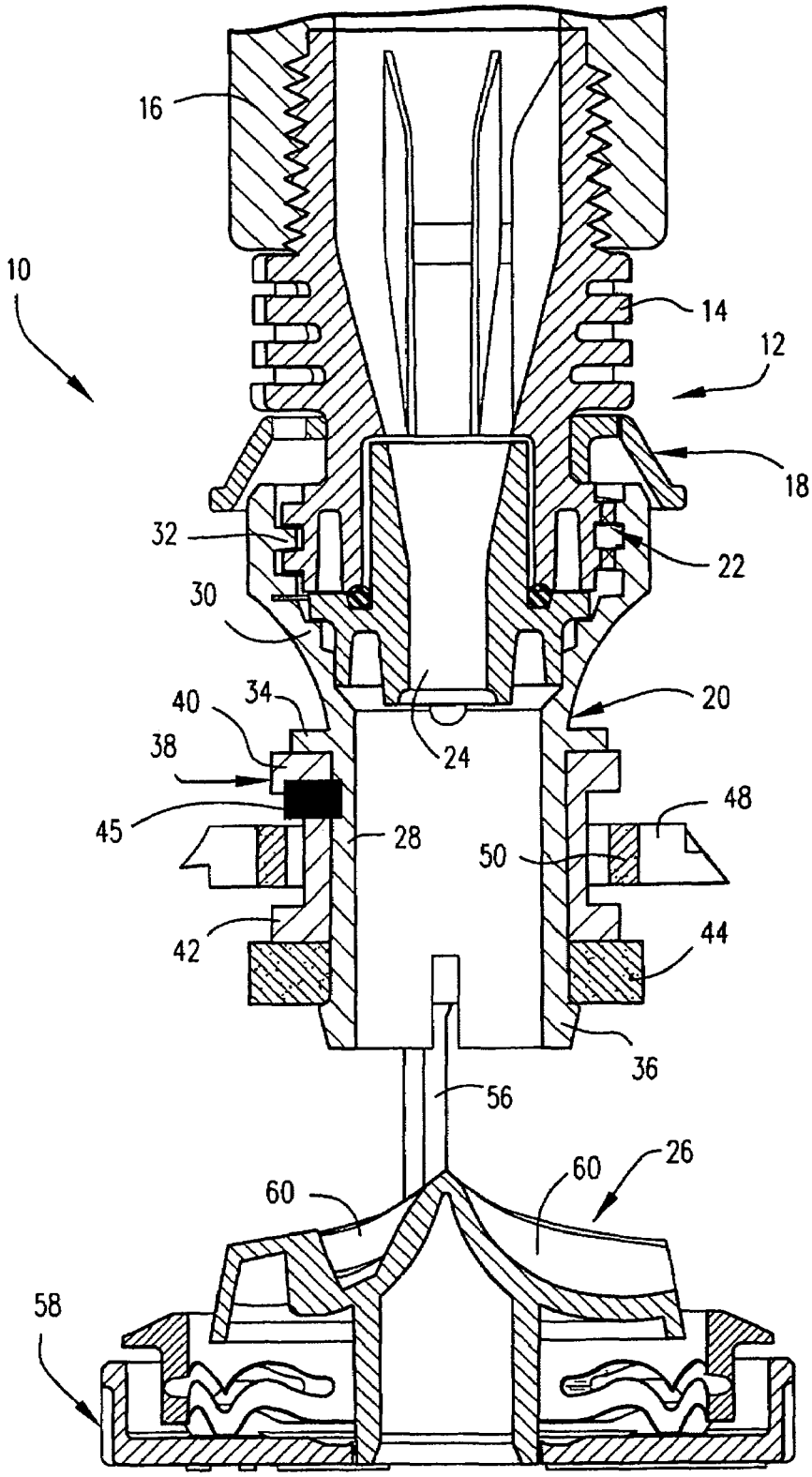
FIG. 2 is a cross section taken along the longitudinal center axis of the sprinkler head in FIG. 1.

With reference to FIGS. 1 and 2, a sprinkler head 10 includes a sprinkler body assembly 12 made up of an adaptor 14 for securing the sprinkler head to a flexible conduit, fixed riser or other irrigation component 16; a nozzle body 18 (FIG. 2); and a spindle 20. As best appreciated from FIG. 2, the nozzle body 18 is sandwiched between the adaptor 14 and the spindle 20 which are secured together via a threaded connection at 22. The nozzle body 18 is formed with an orifice 24 that emits a solid stream of water that passes through the spindle 20 to atmosphere, and toward a distribution plate 26 described further hereinbelow.

The spindle 20 is formed with a substantially cylindrical portion 28 (FIG. 2) that widens into a cone-shaped portion 30. The cone-shaped portion receives a portion of the nozzle body and is provided with internal threads 32 for the connection 22. The cylindrical portion 28 is delineated by a pair of radial flanges 34, 36 at opposite ends thereof. A double-flanged spool 38 is interference-fit (or otherwise suitably secured) over the cylindrical portion 28, with radial flanges 40, 42 at opposite ends, such that flange 40 is engaged with flange 34 of the spindle. A spindle magnet ring 44 is pushed onto the spindle portion 28 (over the compressible flange 36), sandwiched between the spool flange 42 and the spindle flange 36.

The water distribution plate 26 is part of a nutating head assembly that includes a three-spoke cage 46 (FIG. 1), one end of which is formed with an annular ring 48 located loosely between the spool flanges 40, 42. A cage magnet ring 50 is located about the inner diameter of the cage ring 48. The three spokes 52, 54 and 56 of the cage 46 extend away from the spindle 20 and support the water distribution plate 26 within an otherwise conventional cap assembly 58. The plate 26 is formed with integral grooves 60 that redirect the stream emitted from the nozzle orifice 24 in a substantially radial direction. In addition, the grooves 60 are curved in a circumferential direction so that the water causes the entire nutating head assembly to rotate about the spool 38. The loose fit of the nutating head assembly on the spool 38 causes the assembly, including the distribution plate 26, to nutate as it rotates, thus insuring a more uniform sprinkling pattern.

In order to prevent stalling during operation, it is desirable to insure that the distribution plate 26 tilts on start up with respect to an axis extending through the center of the sprinkler head 10 and through the nozzle orifice 24. Accordingly, the spindle magnet ring 44 and the cage magnet ring 50 are located adjacent each other, with like poles facing each other (FIG. 2). When at rest, therefore, the magnetic repulsion force between the two magnet rings 44, 50 pushes the cage and cage magnet 50 (and the distribution plate 26) upward along the spool hub 45, away from the spindle magnet 44. Because the force is relatively uniform about the circumference of the magnet rings, the plate 26 is held in a non-tilted or horizontal position, i.e., substantially perpendicular to the sprinkler axis (as shown in FIGS. 1 and 2).

When water is supplied under pressure to the sprinkler head 10, the pressure of the stream impinging on the distribution plate 26 will push the cage 46 and plate 26 downwardly, such that the cage magnet 50 approaches the spindle magnet 44. As the cage magnet 50 approaches the spindle magnet 44, the repulsion force between the magnets increases, creating instability which causes the cage 46 and distribution plate 26 to tilt off axis (see FIG. 3) and begin rotating about the spindle 20 in a nutating or wobbling fashion. Note that spool 38 may be made of a suitable wear-resistant material or have a suitable wear-resistant coating applied over wear-prone surfaces thereof. So long as water under pressure is impinging on the distribution plate 26, the instability of the distribution plate orientation is maintained, thereby preventing a stalling or equilibrium condition where the distribution plate 26 and cage assembly rotate but without the desired nutating action.

In the exemplary embodiment described above, note that there need not be any fixed struts or spokes surrounding the nutating head assembly, eliminating the problem of local water drip-off or drool that leads to excess water collection surrounding the sprinkler head. The struts 56 that are employed rotate with the water distribution plate 26 and thus do not interrupt the streams exiting the plate.

Figure 3:
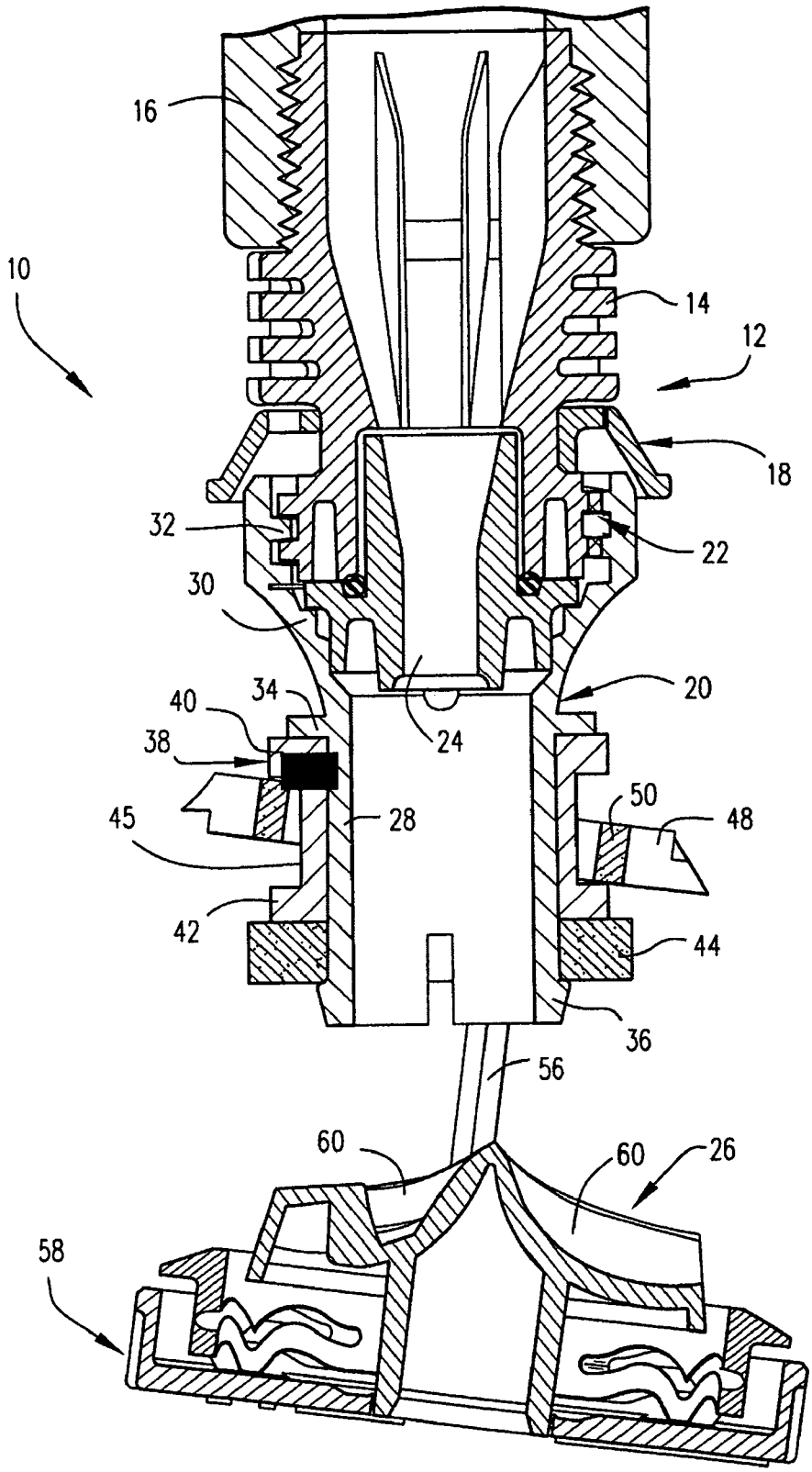
FIG. 3 is a section similar to FIG. 1 but showing the water distribution plate in a tilted or off-axis position.
Figure 4:
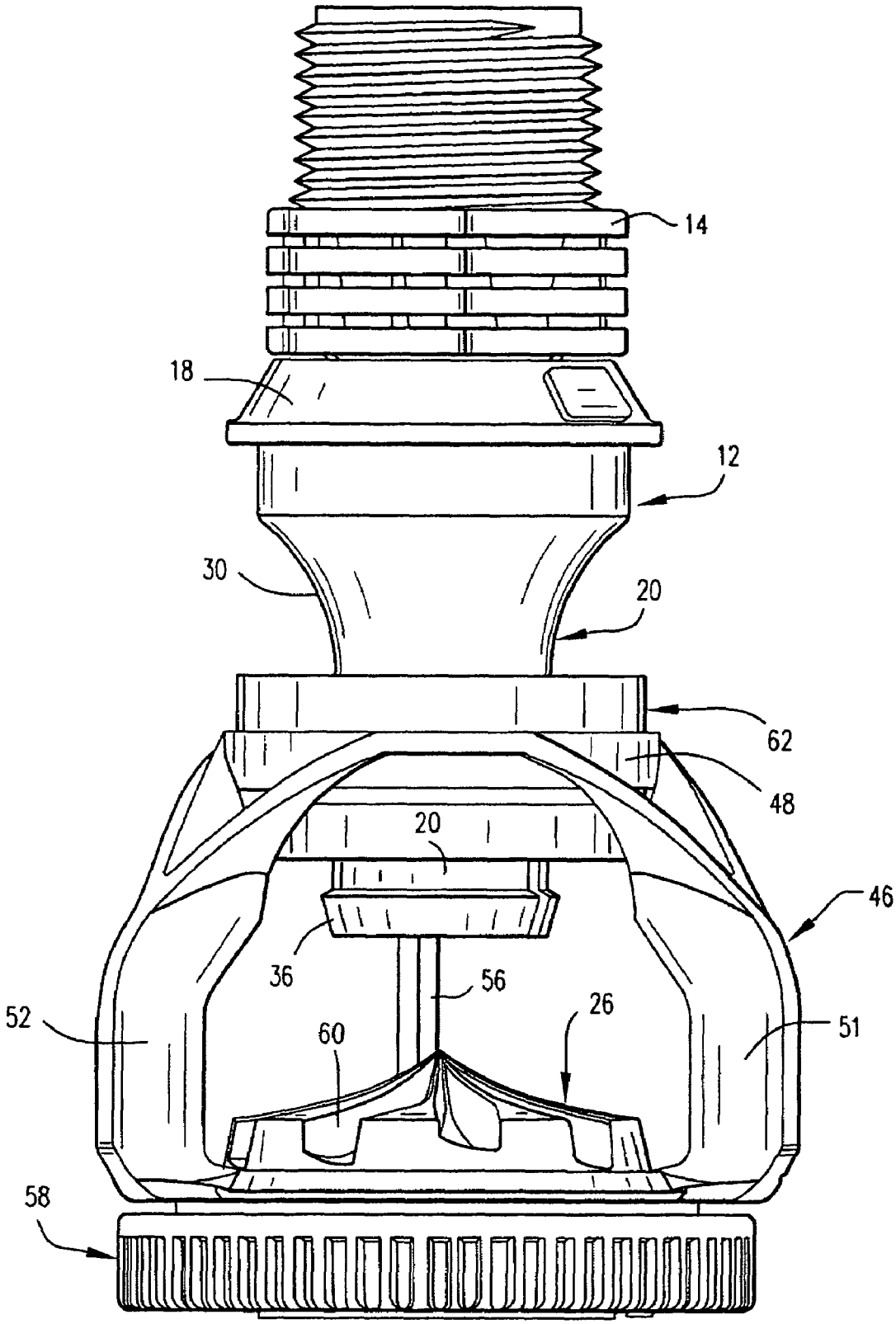
FIG. 4 is a front elevation of a sprinkler head in accordance with a second exemplary embodiment.
Figure 5:
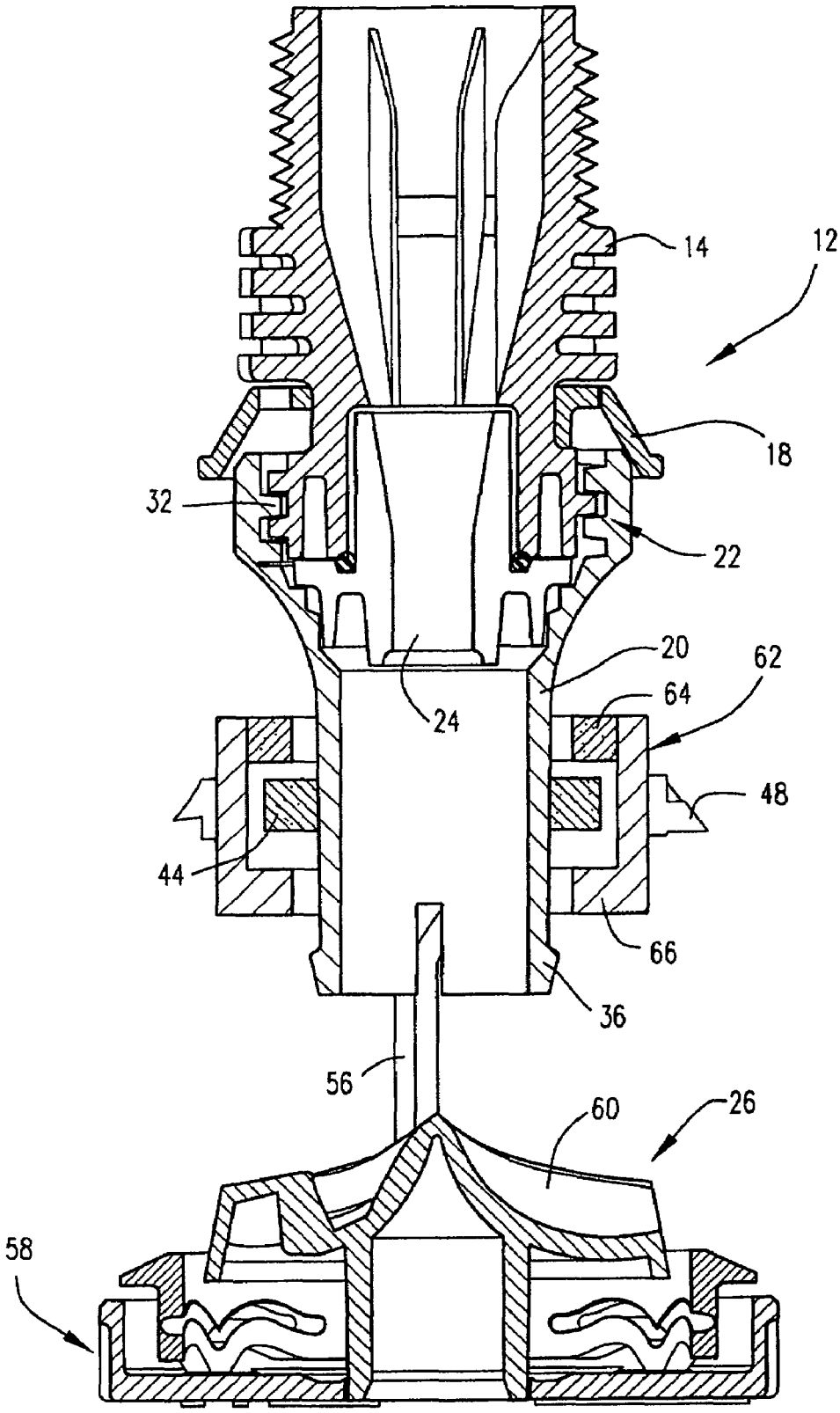
FIG. 5 is a cross section taken along the longitudinal center axis of the sprinkler head in FIG. 4.

In another exemplary embodiment illustrated in FIGS. 4 and 5, the spindle and cage magnets are relocated to different positions relative to one another. For ease of comparison, similar reference numerals are used to designate components corresponding to those used in FIGS. 1-3. In this embodiment, a spool 62 (FIG. 5) is employed that is formed with spool flanges 64, 66 facing radially inwardly towards the spindle 20, and the spindle magnet 44 is relocated axially along the spindle to a fixed position between the spool flanges. At the same time, the upper spool flange 64 and the cage magnet are integrated as a single component, i.e., the cage magnet and upper spool flange 64 are one and the same. Connection 22 is also connected directly to the cage ring 48. In use, the sprinkler head of FIGS. 4, 5 operates substantially identically to the embodiment shown in FIGS. 1-3, noting, however that in this case, the cage 46 nutates with the spool 62 about the spindle 20 and fixed spindle magnet 44.

Figure 6:
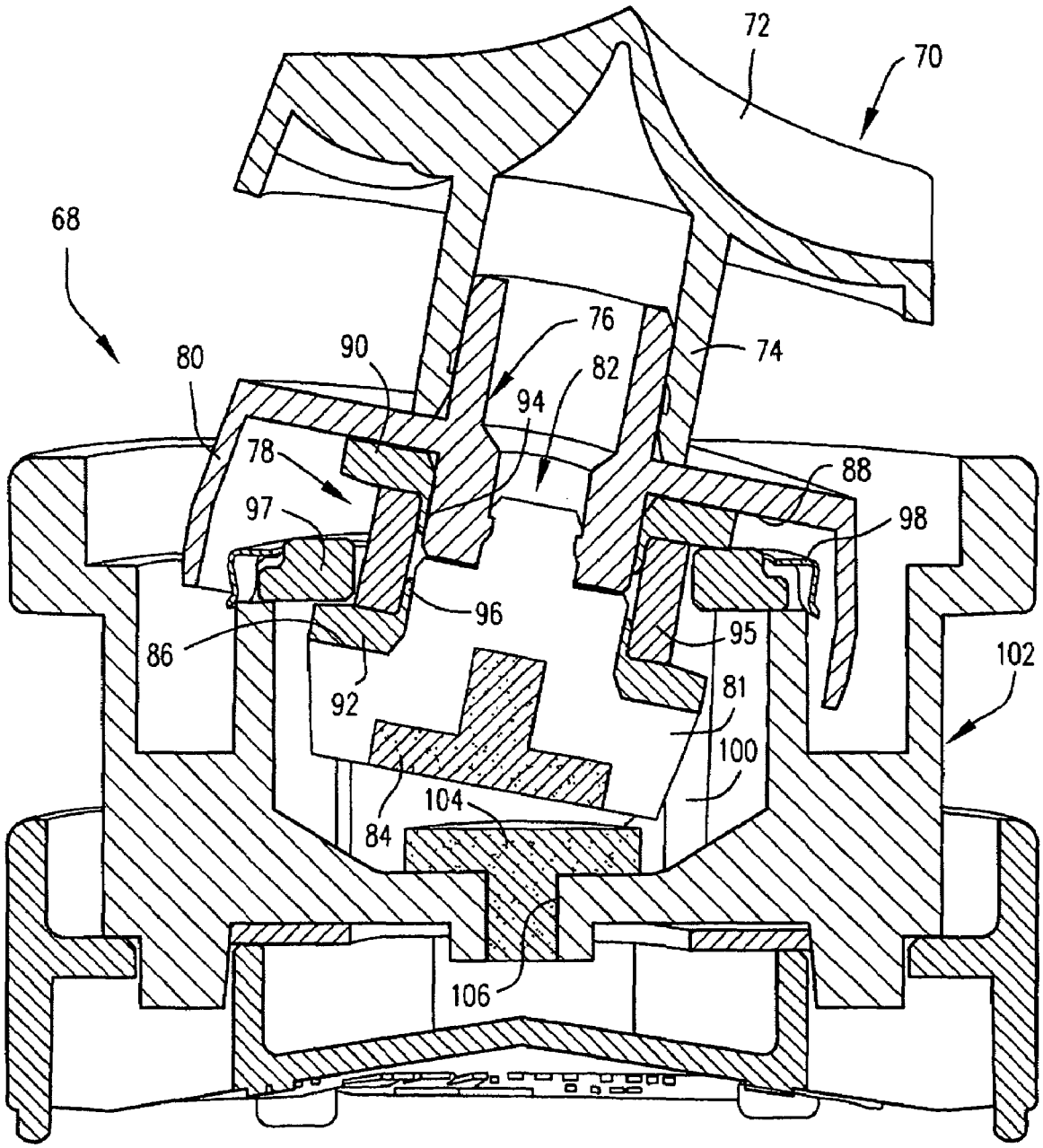
FIG. 6 is a section view taken through a sprinkler head in accordance with a third exemplary embodiment.

In another exemplary embodiment shown in FIG. 6, a nutating head assembly 68 is incorporated into a sprinkler head cap assembly that includes a water distribution plate 70 provided with distribution grooves 72 similar to those described in connection with the embodiments of FIGS. 1-5 that cause the plate to rotate when impinged upon by a stream emitted from a nozzle (not shown). A cylindrical stem 74 of the plate is telescopically received over an upper hub component 76 of a spool assembly 78, in a snap-fit or other suitable attachment arrangement. The upper hub component is shaped to provide an umbrella-like shield 80 that substantially encloses the spool assembly, preventing ingress of debris that might otherwise hamper the nutating action of the head.

A lower hub component 81 is press and snap-fit into the upper hub component 76 at 82. The lower hub component is formed with a first inverted magnet T-shaped disc 84 embedded therein. The lower hub component 81 is also formed with an external annular shoulder 86 and the spool assembly 78 is sandwiched between the shoulder 86 and the underside surface 88 of the shield 80. The spool assembly 78 comprises upper and lower rings 90, 92, each of which has a cylindrical component 94, 96, respectively, which enable the rings to be telescoped over the upper and lower hub components. The rings 90, 92 are separated by a sleeve or spacer 95 that serves as the spool hub.

The spool assembly 78 is loosely secured within an outside ring 97 that may be made of suitable wear-resistant material, such as a ceramic. An annular retainer 98 holds the ring 97 in place. The lower hub component is thus received in a center cavity 100 formed in the body 102 of the cap assembly. At the base of the cavity, a second magnet disc 104 is seated within an aperture 106. Magnet discs 84 and 104 are in opposing relationship, again with like poles facing each other. As in the previously described embodiment, when the sprinkler is at rest, the repulsion force between the magnets are substantially uniform and maintain the distribution plate 70 in a substantially non-tilted position. When a stream from the nozzle (not shown) impinges on the plate 70, however, the nutating head assembly 68 (and magnet disc 84) is pushed towards the magnet disc 104, with increased repulsion forces causing instability and resultant tilting of the assembly 68 to an off-axis position as shown in FIG. 6. The magnetic repulsion forces maintain the tilted orientation, enabling the desired nutating action during rotation, and preventing undesirable stalling.

It should also be noted that the lower hub component 81 may be constructed of any suitably heavy metal material, e.g., brass, to also serve as a counterweight that promotes a controlled nutating action of the assembly 68 as it rotates.

Figure 7:
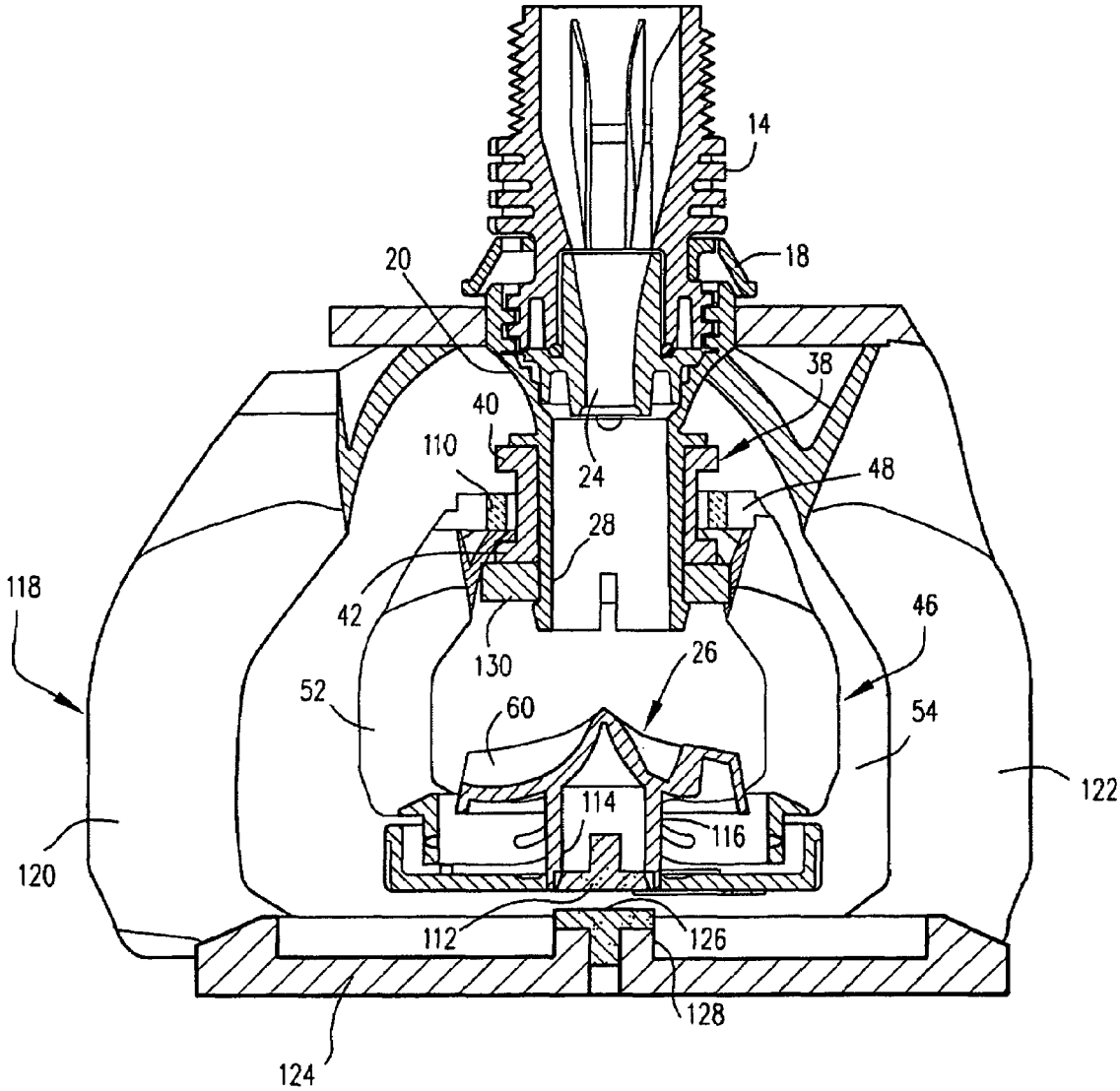
FIG. 7 is a section view taken through a sprinkler head in accordance with a fourth exemplary embodiment.

FIG. 7 illustrates yet another exemplary embodiment that is generally similar to the embodiments disclosed in FIGS. 1-3, but where the magnets have been relocated to an area remote from the spool assembly. More specifically, the cage magnet ring 50 has been replaced by a wear ring 110, and a cage magnet disc 112 has been press-fit into the open end 114 of a hub 116 on the back side of the water distribution plate 26. An outer cage 118 is supported at one end on the spindle 20 and includes plural (e.g., three) struts (two shown at 120, 122) connected at an opposite end to a plate 124. A second magnet 126 is press-fit or otherwise secured in a centrally-located bushing 128 in the plate 124, in juxtaposed relationship to the first magnet 112. This magnet serves the same role as magnet 44 in FIGS. 1 and 2, and note that magnet 44 has been replaced in FIG. 7 by a fixed support ring 130. Here, the support of the cage 46 and distribution plate 26 on the spool via rings 48 and 110 on the spool 38 is substantially identical to the arrangement in FIGS. 1 and 2. This embodiment operates in substantially the same manner as the embodiments disclosed hereinabove. Thus, absent water under pressure, the repulsion force between magnets 112 and 126 raises the cage 46 and water deflection plate upwardly but in a centered or on-axis position. When the plate 26 is impinged upon by a stream emitted from the nozzle orifice 24, the cage 46, water deflection plate 26 and disc 112 are moved toward the magnet disc 126, increasing the repulsion force and causing the distribution plate 26 (and cage 46) to tilt to an off-axis position, resulting in the desired nutating action during rotation.

Figure 8:
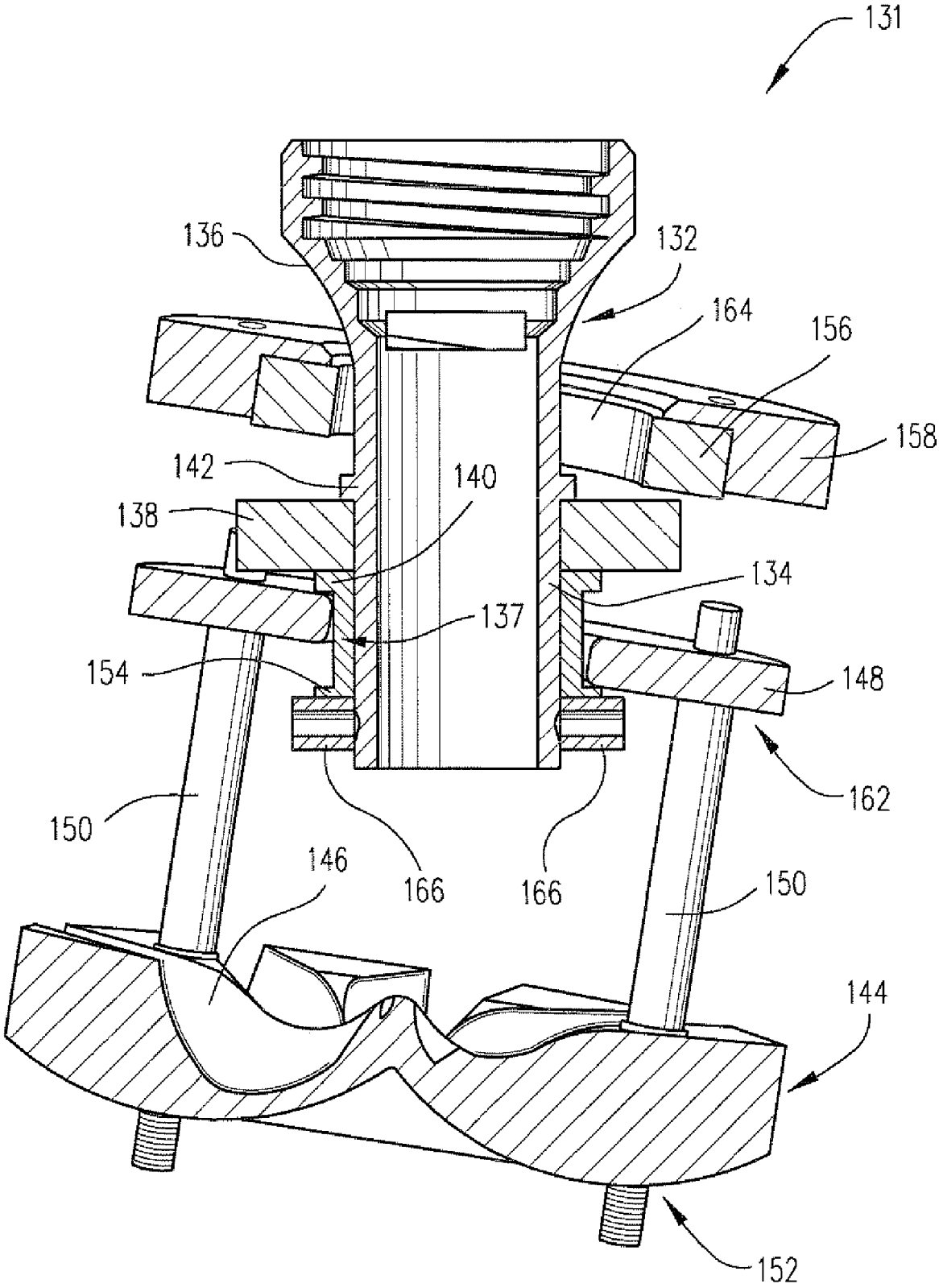
FIG. 8 is a side elevation section view taken through a sprinkler head in accordance with a fifth exemplary embodiment, with the water distribution plate and nutating cage shown in a tilted or off-axis position.
Figure 9:
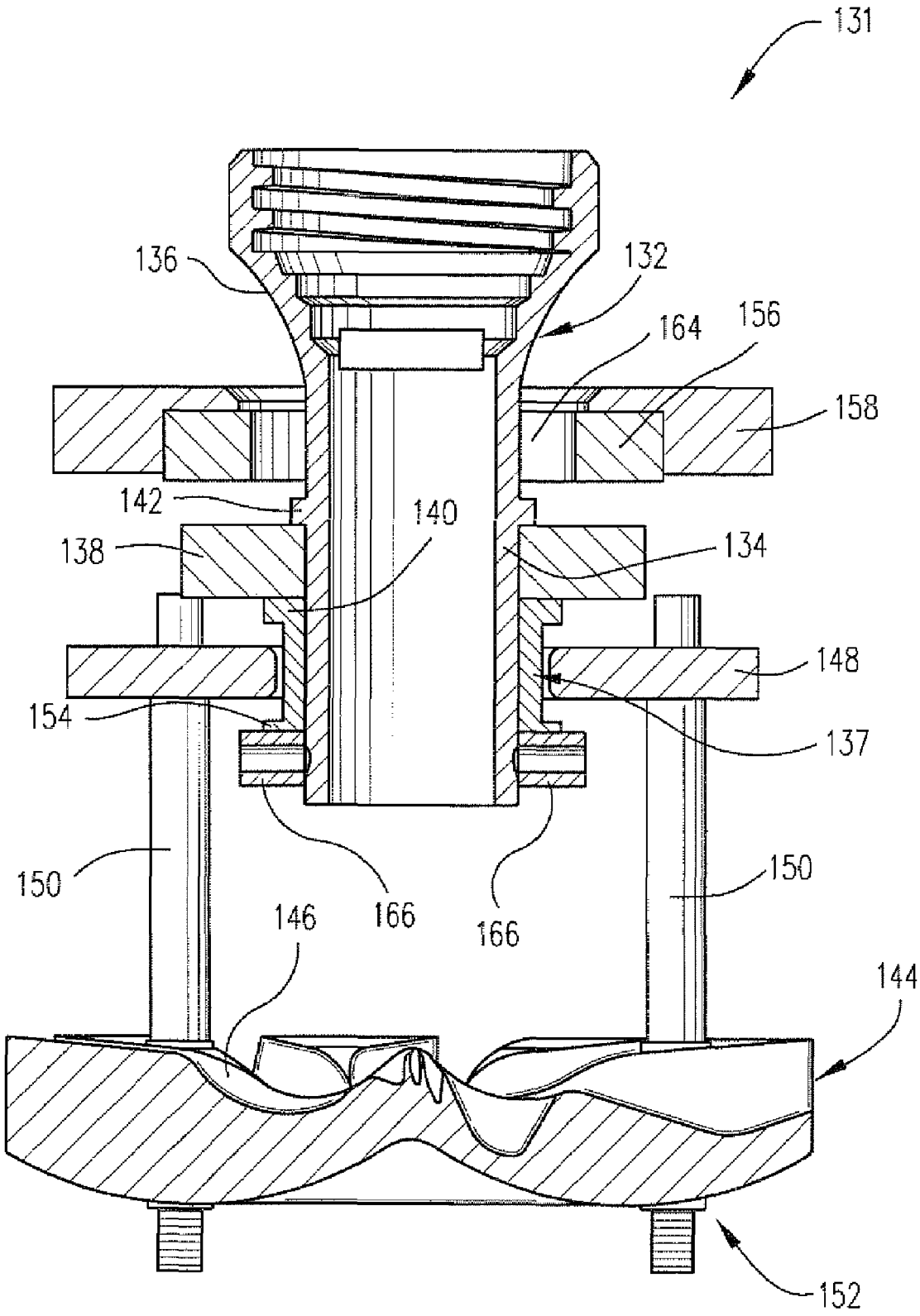
FIG. 9 is a section view similar to FIG. 8 but with the water distribution plate and nutating cage in an axially aligned position.
Figure 10:
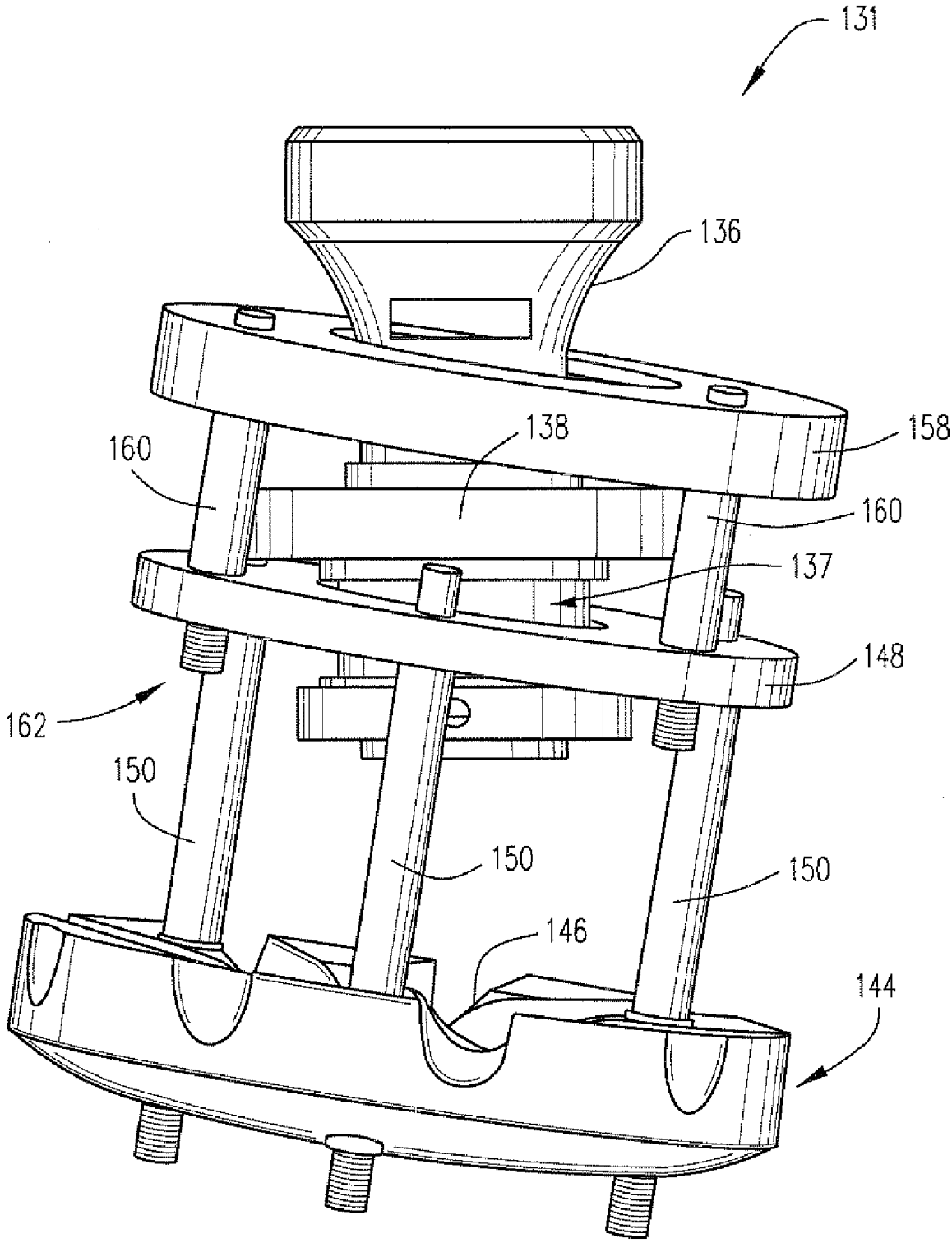
FIG. 10 is a side elevation of the device as shown in FIG. 9 but in full line view and showing the attachment between the intermediate support ring.

FIGS. 8-10 illustrate a presently preferred exemplary embodiment that is generally similar to the embodiments disclosed in FIGS. 1-5 but where the spindle and cage magnets are again relocated to different positions relative to each other and to the spindle. It is also noted that other components of the sprinkler body assembly, e.g., the adapter that secures the sprinkler head to a flexible or other conduit and the nozzle (similar to the adapter 14 and nozzle body 18 in FIG. 2), have been omitted for simplicity.

With specific reference to FIG. 8, the sprinkler body assembly 131 includes (in addition to the adapter and nozzle components, not shown) a spindle 132 formed with a substantially cylindrical portion 134 that widens into a cone-shaped portion 136. Spindle 132 is otherwise substantially identical to the spindle 20 shown in FIGS. 1 and 2 and additional details need not be repeated here.

The cylindrical portion 134 mounts a double-flanged spool 137 that may be interference fit or otherwise suitably secured over the spindle. A spindle magnet 138 (also referred to herein as a second magnet or a spindle magnet ring) is similarly received over the cylindrical portion 134, sandwiched between the upper flange 140 of the spool 137 and a radial flange 142 formed integrally with (or added to) the cylindrical portion 134.

A water distribution plate 144, formed with one or more generally oriented grooves 146, is suspended from the spindle by means of a support ring 148 that is connected to the distribution plate 144 by means of a plurality of (e.g., three) cylindrical struts 150 that may be threaded into the ring 148 at one end and be secured to the water distribution plate by means of a thread and nut connection at 152. If desired, strut 150 may comprise a solid rod, threaded at each end, or a discrete sleeve may be telescopically received over a longer rod, threaded at both ends.

In this embodiment, a cage magnet 156 (also referred to herein as a first magnet or a cage magnet ring) is embedded in or otherwise secured to an upper cage ring 158 that is attached to the support ring 148 by a plurality of threaded struts 160 (see FIG. 10) of similar construction to the struts 150 that connect the support ring 148 to the water distribution plate 144. In an alternative arrangement, the struts 150 could simply extend further in an upward direction to also secure the upper cage ring 158 and cage magnet ring 156.

However assembled, the mounting ring 148, water distribution plate 144 and upper cage ring 158 (including the cage magnet 156) form a nutating cage 162.

As in the previously described embodiments, the cage magnet ring 156 and the spindle magnet ring 138 are substantially axially aligned with like poles facing each other so as to create a repelling force therebetween. Since the inner diameter 164 of the cage magnet 156 is significantly larger than the outer diameter of the cylindrical portion 134 of the spindle 132, and because of the loose fit between the support ring 148 and the spool 137, it will be appreciated that the cage 162 (including the water distribution plate 144) is able to nutate relative to the spindle 132 as it simultaneously rotates about its own center axis. In fact, even before water or other liquid is introduced into the spindle 132 for impingement on the water distribution plate 144, the repelling force between the spindle magnet 138 and the cage magnet 156 will result in the cage assembly tilting to an off-axis position as shown in FIG. 8. In other words, the aligned condition, as illustrated in FIG. 9, as a practical matter, will not normally be achieved. (FIG. 9 shows the components in an axially aligned position merely to facilitate an understanding of the embodiment.) It will further be appreciated that water under pressure impinging on the water distribution plate 144 will tend to drive the cage in a downward direction, with cage magnet 156 moved closer to the spindle magnet 138, thus increasing the repelling force of the magnets and the positional instability between the cage 162 and the spindle 132, essentially eliminating any possibility of a stall condition where the water distribution plate and the spindle are axially aligned as shown in FIG. 9.

Note that sleeved set screws may be employed at 166 to insure that the spool 137 remains in place on the spindle 132.

It will also be appreciated that because the struts 150 rotate along with the water distribution plate 144, undesirable drip or run off from the sprinkler head, which otherwise would occur in constructions where the water distribution plate rotates relative to fixed struts, is also eliminated.

While the examples above have been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A sprinkler comprising:

a sprinkler head incorporating a nozzle;

a spool fixed to said sprinkler head in proximity to said nozzle;

a cage assembly loosely mounted on said spool, said cage assembly including a distribution plate at a first end of said assembly downstream of said nozzle and a first magnet at a second opposite end of said assembly upstream of said spool;

a mounting element fixed to said assembly between said first and second ends, an inner edge of said mounting element loosely confined between upper and lower flanges of said spool; and a second magnet fixed to said sprinkler head, axially between said spool and said first magnet.

2. The sprinkler of claim 1 wherein said first and second magnets are proximate each other, with like poles facing each other.

3. The sprinkler of claim 1 wherein said distribution plate is connected to said mounting element by a first plurality of struts.

4. The sprinkler of claim 3 wherein said mounting element is connected to a component carrying said first magnet by a second plurality of struts.

5. The sprinkler of claim 1 wherein said first and second magnet each comprise annular ring magnets.

6. The sprinkler of claim 4 wherein said first magnet is fixed within a radially inner portion of another ring at said opposite end of said assembly.

7. The sprinkler of claim 1 wherein said distribution plate is formed with a plurality of grooves curved in a circumferential direction such that water emitted from said nozzle and impinging on said plurality of grooves will cause said distribution plate assembly to nutate about said sprinkler head.

8. The sprinkler of claim 7 wherein said first and second magnets have like poles facing each other such that first magnet is repelled from said second magnet, causing said distribution plate assembly to tilt relative to a longitudinal axis through said sprinkler head.

9. The sprinkler of claim 8 wherein said mounting element engages a center portion of said spool as it nutates about said sprinkler head.

10. A sprinkler comprising:

a sprinkler head having a center axis incorporating a nozzle, said sprinkler head and nozzle adapted to emit a stream in a downward direction;

a spool fixed to said sprinkler head in proximity to said nozzle;

a nutating cage assembly loosely mounted on said spool, said notating cage assembly including a distribution plate located at a first end of said notating cage assembly downstream of said nozzle and formed with one or more grooves adapted to receive the stream emitted from said nozzle, and an upper cage ring at a second opposite end of said nutating cage assembly, upstream of said nozzle and said spool;

a mounting ring fixed to said nutating cage assembly between said first and second ends, said mounting ring loosely confined between upper and lower flanges of said spool;

wherein said upper cage ring and said distribution plate are connected to said mounting ring by a plurality of struts.

11. The sprinkler of claim 10 wherein said upper cage ring carries a first magnet, and said sprinkler head carries a second magnet in proximity to said first magnet.

12. The sprinkler of claim 11 wherein said first and second magnets arc arranged such that like poles face each other to thereby establish a repelling force that causes said nutating cage assembly to tilt to an off-axis position.

* * * * *